United States Patent [19]

Anders et al.

[11] 4,025,223

[45] May 24, 1977

[54] FAN ARRANGEMENT

[75] Inventors: Klaus Anders, Fischbach; Heinz-Werner Faatz, Usingen, both of Germany

[73] Assignee: Braun Aktiengesellschaft, Frankfurt am Main, Germany

[22] Filed: Nov. 11, 1975

[21] Appl. No.: 631,152

[30] Foreign Application Priority Data

Dec. 4, 1974 Germany ..... 2457183

[52] U.S. Cl. ..... 415/54; 415/119

[51] Int. Cl.[2] ..... F04D 5/00; F04D 29/66

[58] Field of Search ..... 181/36 A, 35 A; 415/54, 415/119

[56] References Cited

UNITED STATES PATENTS

| | | | |
|---|---|---|---|
| 353,994 | 12/1886 | Walker | 415/119 |
| 1,291,037 | 1/1919 | Lole | 415/119 |
| 1,350,927 | 8/1920 | Gomborow | 415/119 |
| 1,350,941 | 8/1920 | Rice | 415/119 |
| 3,232,522 | 2/1966 | Laing | 415/54 |
| 3,469,773 | 9/1969 | Pool et al. | 415/54 |

FOREIGN PATENTS OR APPLICATIONS

| | | | |
|---|---|---|---|
| 2,023,591 | 12/1971 | Germany | 415/54 |
| 250,995 | 7/1948 | Switzerland | 415/119 |
| 14,668 | 1912 | United Kingdom | 415/119 |
| 579,770 | 8/1946 | United Kingdom | 415/119 |

*Primary Examiner*—Henry F. Raduazo
*Attorney, Agent, or Firm*—Michael J. Striker

[57] ABSTRACT

A fan arrangement has an inlet bounded by an edge portion. A rotor has impeller blades which respectively sweep past the inlet. The edge portion forms an angle with each of the impeller blades so that noise generated by the blades during their rotation is substantially reduced. The edge portion may have any arbitrary shaped outline, such as linear, annular or curvilinear.

15 Claims, 10 Drawing Figures

FIG. 9
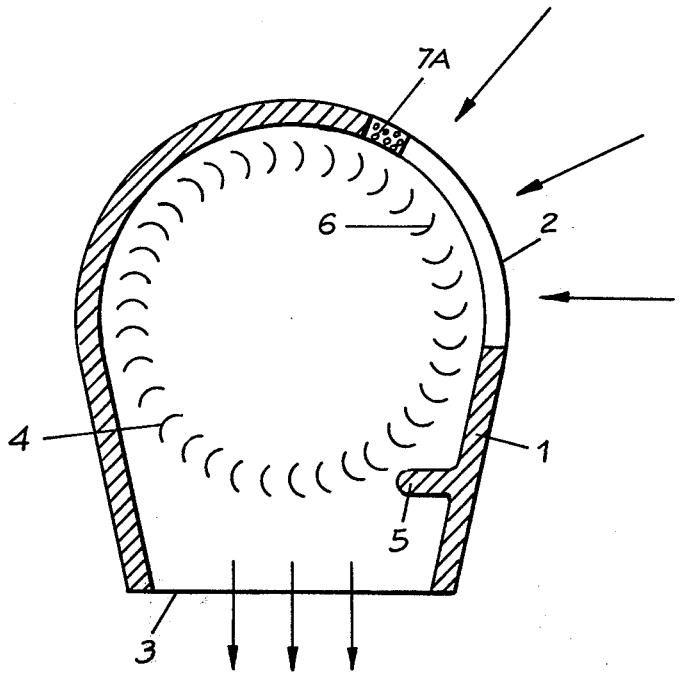
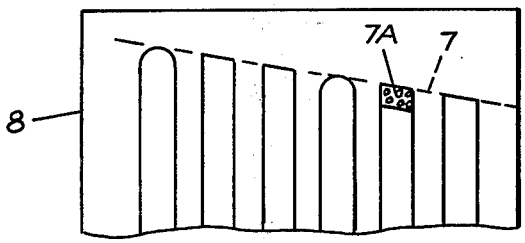
FIG. 10

FAN ARRANGEMENT

BACKGROUND OF THE INVENTION

The present invention relates to a fan arrangement and, more particularly, to an air-circulation arrangement which reduces the noise generated by impeller blades of a rotor during their rotation.

In air-circulation arrangements, such as fans or blowers used in hair-dryers or the like, undesirable noise is generated as the impeller blades of a rotor sweep past the inlet and outlet openings provided in the housing of the air-circulation arrangement. As the air is either drawn in or discharged from the openings of the housing, it impinges along the entire length of the edge portions which bound these respective openings since the edge portions are aligned parallel to the horizontal edges of the impeller blades. Large vibrations are thereby generated which, in turn, cause the undesirable noise.

The prior art has attempted to reduce this noise, which frequently is a whistling sound, by utilizing a variety of techniques. Thus, it has been proposed to twist the impeller blades. However, this approach is very uneconomical.

It has also been proposed to unequally distribute the impeller blades on the rotor. However, this approach makes the manufacture of the rotor very expensive.

Still a further approach of the prior art has proposed to utilize porous material at the inlet opening. However, this technique has not proved to be altogether satisfactory in reducing the undesirable whistling sound.

SUMMARY OF THE INVENTION

Accordingly, it is a general object of the present invention to overcome the disadvantages of the prior art.

More particularly, it is an object of the present invention to substantially reduce and eliminate undesirable noise generated by the impeller blades of an air-circulation arrangement.

Another feature of the present invention is to provide a fan arrangement which dampens undesirable sounds in an economical manner.

In keeping with these objects and others which will become apparent hereinafter, one feature of the invention is to amount a rotor having impeller blades in a housing which, in turn, has inlet means that is bounded by an edge portion. Each of the impeller blades sweeps past the inlet means and respectively defines a predetermined angle with the edge portion of the inlet means.

This feature overcomes the disadvantages of the prior art and achieves the aforementioned advantages in a novel manner. By orienting the edge portion so that it is not parallel to each respective edge of the blades, the vibration force caused by the air pressure of the rotating blades does not simultaneously impinge against the entire length of the edge portion of the inlet means. Instead, the vibration force is broken up and distributed over the entire length of the edge portion of the inlet means per unit time. The undesirable noise level is almost completely reduced, and the resulting overall noise level of the fan arrangement is either totally eliminated or decreased to a constant low-level hum.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 9. is a partial view of a ninth embodiment according to the present invention; and FIG. 10 is a partial view of a tenth embodiment according to the present invention.

DESCRIPTION OF THE PREFERRED EMBODIMENTS

Figure 1:
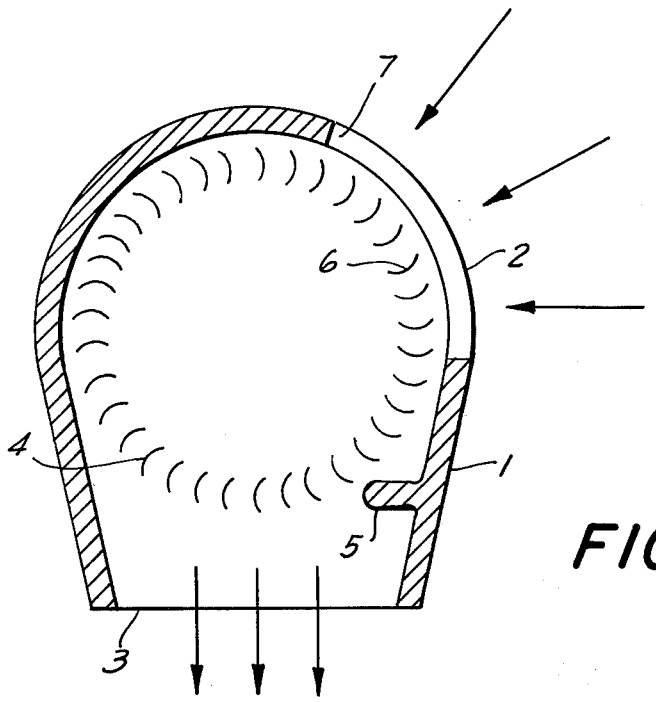
FIG. 1 is a view in vertical section of a fan arrangement showing a first embodiment according to the present invention.

FIG. 1 diagrammatically illustrates a basic fan or blower arrangement. Reference numeral 1 identifies a housing having a first opening or inlet means 2 and a second opening or outlet means 3. The rotor 4 is mounted within the interior of the housing 1 and is adapted to rotate about an axis in the counterclockwise direction as diagrammatically indicated by the curved arrow.

A plurality of impeller blades 6 is mounted on the rotor 4 and is adapted to draw a gaseous medium, such as air, from the ambient atmosphere through the inlet means 2 in a flow path towards the outlet means 3 and thereupon back to the ambient atmosphere. The air flow into the inlet means 2 and out of the outlet means 3 is diagrammatically illustrated by the linear arrows. A projection 5 is provided on the housing 1 intermediate the inlet means 2 and the outlet means 3 for guiding the major portion of the air outwardly towards the outlet means 3 by preventing the air from being conveyed and returned back to the inlet means 2.

In one purely exemplary application and not intended to be self-limiting in any manner, the fan arrangement can be used as a hair-dryer. In this event, a conventional heating coil (not-illustrated) is placed adjacent the outlet 3 so that, during the rotation of the rotor, the blades 6 will draw air into the housing 1 over the heating coil and discharge the heated air out of the housing 1.

The edge portion 7 of the inlet means 2 is a major contributing factor in causing undesirable sound vibrations. If the edge portion 7 is aligned parallel to the edge of the blades 6 of the rotor 4, then an unacceptable level of noise is generated whose frequency and amplitude is dependent upon, among other things, the total number of blades 6 and the speed or rotation of the rotor 4. The undesirable noise is due to the fact that the air is simultaneously urged at all points along the entire upper length of the edge portion 7 as each of the blades 6 sweeps past the edge portion 7.

Thus, in order to substantially reduce and eliminate the noise, it is proposed to form the edge portion 7 so that it is no longer parallel to the blades 6 and defines a predetermined angle with each of the blades 6. The angle is an acute angle, preferably in the range between 5° and 35°.

Consequently, in a first embodiment, it will be understood that, in FIG. 1, the edge portion 7 is tapered in the axial direction, that is into the plane of the Figure, and forms an acute angle with each respective blade 6.

Figure 2:
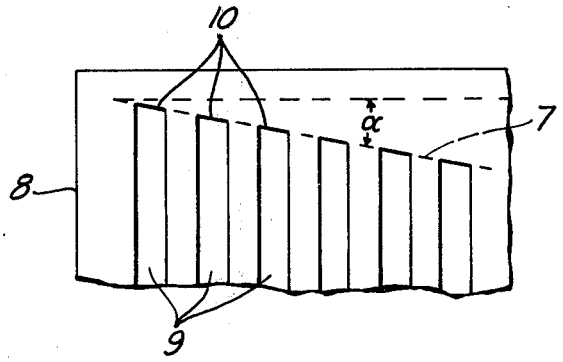
FIG. 2 is a partial view of a second embodiment according to the present invention.

In FIG. 2, a grid or covering plate 8 is partially illustrated and serves to cover the inlet opening 2 shown in FIG. 1. The plate has a plurality of elongated slots 9 spaced adjacent each other in the axial direction, that is from right to left in FIG. 2. The slots 9 have a quadrilateral outline, and their upper narrow side portions 10 are linear and are tapered in the axial direction. Successive ones of the elongated slots 9 have lengths which respectively decrease in the axial direction so that the upper narrow side portions 10 all lie on a common line. This common line is illustrated by the sloping-dashed line of FIG. 2 which corresponds to the axial extension of the edge portion 7. The imaginary horizontal-dashed line illustrated in FIG. 2 corresponds to the level of a blade 6 as it sweeps past the inlet opening 2. The angle $\alpha$ is equal for each blade 6 and can be any angle other than zero degrees.

In operation, the blades 6 of the rotor 4 rotate underneath the plate 8. Now, the sound- or air-pressure vibrations do not simultaneously impinge at all points along the entire length of the edge portion 7. Instead, each blade 6 overlies only a relatively small portion of the length of the edge portion 7 per unit time. This means that the maximum vibration force generated by a horizontal blade 6 is divided into smaller components per unit time. Initially, each blade 6 overlies the slots 9 which are furthest to the right in FIG. 2. Then, each blade 6 successively overlies those slots which lie more towards the left side of the plate 8.

Thus, the amplitude level of the undesirable sound is strongly reduced thereby and is scarcely noticeable any longer.

Figure 3:
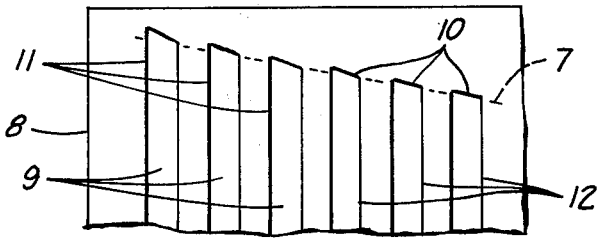
FIG. 3 is a partial view of a third embodiment according to the present invention.

This principle of operation is basically the same for the remaining illustrated embodiments. In FIG. 3, the plate 8 comprises a plurality of elongated slots 9 whose upper narrow tapered side portions 10 are linear, but do not lie on a common line. Instead, the side portions 10 respectively lie on a set of parallel lines. The longitudinal side portion II on the left side of each slot 9 is longer than its correspondingly associated longitudinal side portion 12 on the right side of each slot 9. Each shorter longitudinal side portion 12 of a slot 9 is as large as the longer longitudinal side portion 12 that is associated with the neighboring slot to the right of the first-mentioned slot. The dashed line correcting the upper points of the shorter side portions 12 is slightly spaced from and approximately parallel to the dashed line connecting the upper points of the longer side portions 11. Both dashed lines form a predetermined angle with the blades 6, as explained above.

Figure 4:
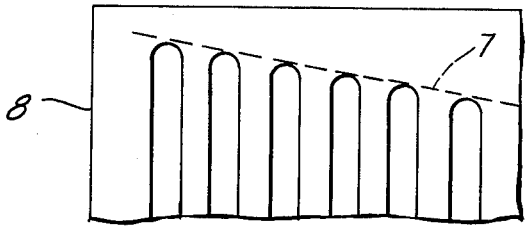
FIG. 4 is a partial view of a fourth embodiment according to the present invention.

In FIG. 4, the upper narrow side portions 10 are shaped as arcs, whose common tangent forms the aforementioned predetermined angle with each of the blades 6. The arcs can be shaped as semi-circles or semi-ellipses or may have any other arcuate shape.

Figure 5:
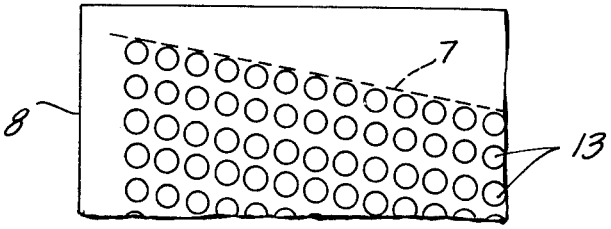
FIG. 5 is a partial view of a fifth embodiment according to the present invention.

In the embodiment of FIG. 5, it will be understood that the present invention is not intended to be limited to providing slots in the plate 8. Thus, a plurality of apertures, such as annular holes 13, are arranged in rows. The common tangent of the upper row forms the aforementioned predetermined angle.

Figure 6:
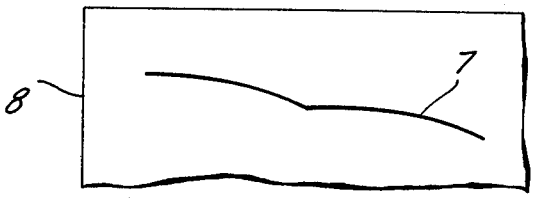
FIG. 6 is a partial view of a sixth embodiment according to the present invention.
Figure 7:
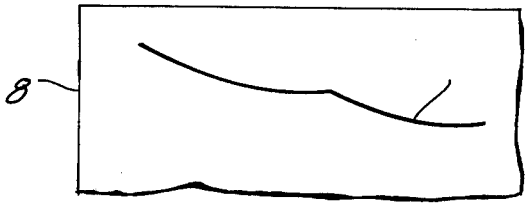
FIG. 7 is a partial view of a seventh embodiment according to the present invention.

In the embodiments of FIGS. 6 and 7, the edge portion 7 does not taper linearly in the axial direction. Instead, the edge portion 7 is arcuately shaped and, in FIG. 6, comprises a set of curvilinear convexly-curved arcs and, in FIG. 7, comprises a set of curvilinear concavely-curved arcs. The common respective tangents of the respective edge portions 7 form the aforementioned predetermined angle.

It will be understood that, in order to achieve the noise-dampening effect of the present invention, the most important consideration is the outline of the edge portion 7, rather than the choice of which type of plate 8 having whatever slot or aperture. Consequently, as noted above, in connection with FIG. 1, no plate 8 need be provided at all, so long as the opening 2 has an edge portion 7 which has an outline according to the teaching of the present invention. The outline may be linear, arcuate or curvilinear or any interchangeable combination thereof. For example, the embodiment of FIG. 10 illustrates a row of slots, some of which have linear outlines, while others of which have arc shaped outlines. Of course, the outline may be comprised of porous material 7A as well.

The lower edge portion of the inlet opening 2 generally is not a major contributing factor to the generation of undesirable noise, because the air at the lower edge portion does not impinge at the same speed as the air at the upper edge portion 7. However, if this assumption is no longer true in a particular application, then the considerations mentioned herein can also be fully executed for the lower edge portion of the inlet opening 2.

In the embodiments of FIGS. 2–4, the elongated slots 9 are shown to be open over their respective longitudinal lengths. In order to increase the mechanical rigidity of the respective plates 8, cross-ribs extending in the axial direction can be used. In this case, such cross-ribs are likewise oriented to form the aforementioned predetermined angle with each of the blades 6.

Figure 8:
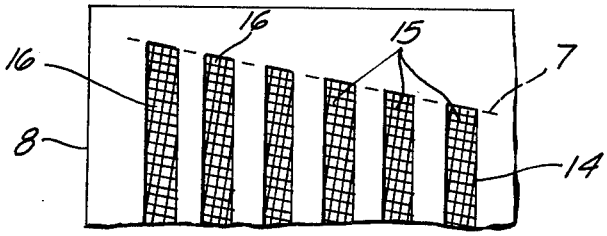
FIG. 8 is a partial view of an eighth embodiment according to the present invention.

In the embodiment of FIG. 8, a mesh screen 14 is secured by adhesive means underneath the cover plate 8 so as to overlie the inlet opening 2 and thereby prevent the entrance of foreign objects, such as hair in a hair-drying application, into the interior of the housing 1.

Such mesh screens 14 are generally composed of first ribs and second ribs which form a predetermined angle, for example, 45°, with each of the blades 6. Although we have found that this orientation of the ribs does, in fact, reduce the noise level somewhat, test results have not proven altogether satisfactory because simultaneously-acting pressures of the same frequency occur at the cross points of the ribs. Therefore, in order to still further reduce the noise level, we orient the pair of ribs as indicated in FIG. 8.

First ribs 15 are caused to extend generally in the longitudinal direction, and second ribs 16 are arranged parallel to the inclined edge portion 7. The first ribs 15 may be vertical, or, preferably, as shown in FIG. 8, the first ribs 15 are oriented perpendicularly to the second ribs 16.

In the final embodiment of FIG. 9, the edge portion 7A is comprised of porous material. Noise reduction is achieved by shaping the porous material so that its edge portion defines a predetermined angle with each of the blades.

The noise-reducing features described above may also be used, in a similar manner, to modify the edge portions bordering the outlet opening 3 and the edge portion at the end of the projection 5.

It will be understood that each of the elements described above, or two or more together, may also find a useful application in other types of constructions differing from the types described above.

While the invention has been illustrated and described as embodied in a fan arrangement, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a fan arrangement, a combination comprising a housing having inlet means for admitting air, and outlet means spaced from said inlet means and operative for discharging air from said housing; a rotor mounted in said housing for rotation about an axis, said rotor having straight-edged impeller blades which sweep past said inlet and outlet means to thereby draw air through said inlet means into the interior of said housing and for thereupon expelling the drawn-in air through said outlet means towards the exterior of said housing; and means for reducing noise generated by incoming air which passes through said inlet means, said reducing means including an impact edge partially bounding said inlet means and being elongated on said housing so as to form an angle with respective straight-edged blades as the latter sweep past said inlet means.

2. A combination as defined in claim 1, wherein said inlet means comprises an aperture, and wherein said impact edge is located on said housing and bounds said aperture at least in part.

3. A combination as defined in claim 1, wherein said inlet means comprises wall means bounding a plurality of spaced elongated slots having respective upper side portions which constitute said impact edge.

4. A combination as defined in claim 3, wherein successive ones of said elongated slots have lengths which decrease in the axial direction, and wherein each of said upper side portions are linear and lie on a common line which forms said angle with each of said blades.

5. A combination as defined in claim 3, wherein successive ones of said elongated slots have lengths which decrease in the axial direction, and wherein each of said upper side portions are linear and lie on respective lines, each of said lines being parallel to each other and each of said upper side portions forming said angle with each of said blades.

6. A combination as defined in claim 3, wherein successive ones of said elongated slots have lengths which decrease in the axial direction, and wherein said upper side portions are shaped as arcs whose common tangent forms said angle with each of said blades.

7. A combination as defined in claim 6, wherein said arcs of said upper side portions have an elliptical outline.

8. A combination as defined in claim 6, wherein said arcs of said upper side portions have a semicircular outline.

9. A combination as defined in claim 1, wherein said inlet means comprises a plurality of circular aperatures having respective upper arcuate side portions arranged in a row and constituting said impact edge, the common tangent of said respective upper arcuate side portions forming said angle with each of said blades.

10. A combination as defined in claim 1, wherein said impact edge bounds an opening having a continuously curved upper side portion which forms said angle with each of said blades.

11. A combination as defined in claim 3; and further comprising a screen covering said elongated slots for preventing foreign bodies from entering the inlet means of said housing, said screen having first and second ribs which form respective angles with each of said blades as the latter sweep past said screen.

12. A combination as defined in claim 1, wherein said angle is an acute angle, whereby noise generated by said blades is substantially reduced.

13. A combination as defined in claim 1, wherein said impact edge comprises porous material.

14. A combination as defined in claim 1, wherein said inlet means comprises wall means bounding a plurality of spaced elongated slots having interchangeable linear and arc-shaped upper side portions which constitute said impact edge.

15. A combination as defined in claim 1, wherein said blades have a curved cross-section.

* * * * *